US007513835B2

(12) United States Patent
Belmont

(10) Patent No.: US 7,513,835 B2
(45) **Date of Patent: *Apr. 7, 2009**

(54) GOLF CLUB HEADS

(76) Inventor: Peter Angelo Belmont, 60 Glen Avon, Stratford, CT (US) 06614

( * ) Notice: Subject to any disclaimer, the term of this patent is extended or adjusted under 35 U.S.C. 154(b) by 81 days.

This patent is subject to a terminal disclaimer.

(21) Appl. No.: 11/603,402

(22) Filed: Nov. 22, 2006

(65) Prior Publication Data

US 2007/0117651 A1 May 24, 2007

Related U.S. Application Data

(60) Provisional application No. 60/739,365, filed on Nov. 23, 2005.

(51) Int. Cl.
*A63B 53/04* (2006.01)

(52) U.S. Cl. ..... 473/328; 473/345; 473/349; 473/350

(58) Field of Classification Search ..... 473/324–350; D21/733, 747–752, 759
See application file for complete search history.

(56) References Cited

U.S. PATENT DOCUMENTS

| | | | | | |
|---|---|---|---|---|---|
| 1,096,359 | A * | 5/1914 | Dwight | 473/337 |
| D301,907 | S * | 6/1989 | Muta | D21/750 |
| 5,011,151 | A * | 4/1991 | Antonious | 473/242 |
| D329,481 | S * | 9/1992 | Hunt | D21/750 |
| 5,288,079 | A * | 2/1994 | Katayama | 473/328 |
| 6,695,937 | B1 * | 2/2004 | Stites, III | 148/577 |
| D559,932 | S * | 1/2008 | Belmont | D21/747 |
| 2006/0100033 | A1 * | 5/2006 | Nelson et al. | 473/349 |

* cited by examiner

*Primary Examiner*—Sebastiano Passaniti
(74) *Attorney, Agent, or Firm*—Monahan & Costello, LLC; Thomas J. Monahan

(57) ABSTRACT

Golf club heads are described. The present invention is directed to golf club heads that have a thicker and heavier top line region and a thinner and lighter sole region than conventional designs. The novel golf club heads of the invention have a low tendency to get stuck in turf, change the face angle upon impact providing a stronger hitting position, increase the club head speed, and provide straighter and increased flight distance. Golf club irons, fairway woods, and driver are provided.

18 Claims, 11 Drawing Sheets

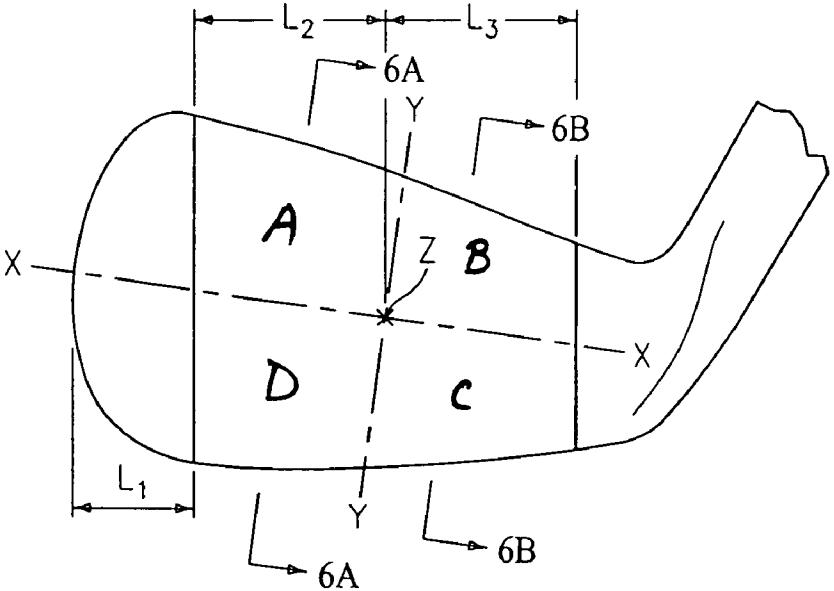
FIG. 6
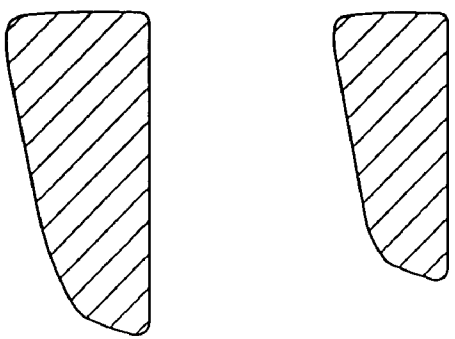
FIG. 6A
FIG. 6B
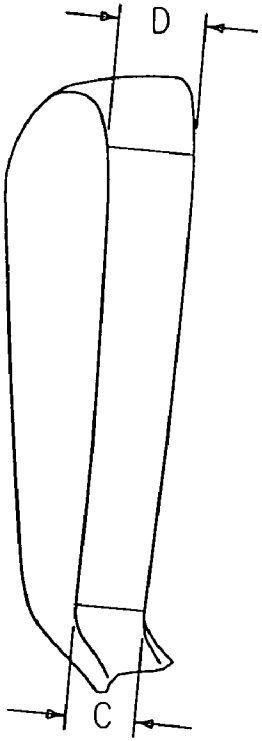
FIG. 5
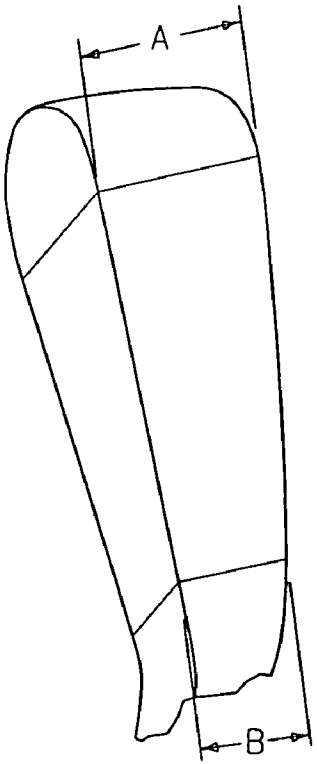
FIG. 4

GOLF CLUB HEADS

This application claims priority from U.S. Provisional Application No. 60/739,365 filed Nov. 23, 2005.

BACKGROUND OF THE INVENTION

1. Field of the Invention

The present invention relates to golf club heads. More specifically, the invention relates to golf club heads that are top-head-weighted and aerodynamic shape. The invention describes various embodiments. The preferred embodiments describe a thicker and heavier top line region of club heads that taper along the vertical axis to a thinner bottom or sole line and also taper along the horizontal axis from a thinner heel to a thicker toe region.

2. Description of the Prior Art

By way of background, there are many variations of golf club designs, including drivers, irons and putters. The complexity of the engineering principles and material science involved in golf club designs are well known. The choice of materials and design for each component of a golf club (i.e., head, shaft, hosel, grip etc.) influence the performance of the club. Among the factors involved in golf club design are loft, lie and face angles, face size, sole curvature center of gravity, overall head weight and selection of materials.

Iron-type golf club heads can generally be divided into three groups: blades, muscle backs and cavity back designs. Blade designs are traditional type designs that are substantially uniform in appearance from the sole to the top line of the head. Some blade designs may have some tapering from a thinner top line to a wider sole. Muscle backs have a substantially traditional appearance very similar to blade designs, but have extra material on the back of the blade (i.e., in the form of a rib) that serve to lower the club head center of gravity. With the club head center of gravity lower than the ball center of gravity at contact, the launch angle of the resulting golf shot is increased. Cavity back head designs are contemporary designs that have a hollow space or cavity in the back of the club head opposite the striking face. Cavity back designs move some of the club mass to the perimeter of the club that allows the size of the club face to be increased resulting in a larger sweet spot.

The so-called "sweet spot" of a golf head is the area of the face of the club that results in a desirable golf show when striking a golf ball. The sweet spot of the club head is generally thought to be that area on the striking face of the club head immediately surrounding the center of gravity of the club head. Perimeter-weighted club heads (i.e., cavity back designs) are generally easier to hit than blades and muscle backs and are useful for less-skilled golfers Both blade and muscle back design have a smaller sweet spot than cavity backs. Blade and muscle back designs are typically used by skilled golfers. Golf head designs adding weigh members to the bottom or sole surface are known (i.e., U.S. Pat. Nos. 3,979,122 and 3,979,123).

A typical set of golf club irons includes eight or nine irons having variation in shaft length, weight, lie and loft among other variable characteristics. For example, the iron that is the lowest weight, longest shaft and the lowest loft is typically the number two iron. The iron having the shortest shaft and the highest loft is typically the wedge. The club head includes a face section for striking a golf ball. The angle between the face and a vertical plane is referred to as the loft angle. The lie angle is the angle formed by the club head and the club shaft.

The sole of the golf club is particularly important to the golf shot because it contacts and interacts directly with the ground during the golf shot. The larger the area of the sole, the more frictional resistance there will be with the ground when striking a golf ball.

It would be desirable to have a golf club that will more efficiently transfer the forces created during the golf swing to a golf ball so as to create a more controlled and/or longer distanced golf shot in comparison to contemporary golf club designs. In addition, it would be desirable to have golf clubs that have less ground resistance that easily go through turf and that have improved aerodynamics. The present invention is directed toward solving these needs.

SUMMARY OF THE INVENTION

Although the present invention describes in detail certain embodiments, it is understood that variations and modification exist known to those skilled in the art to which this invention applies that are within the invention. Accordingly, the present invention is intended to encompass all such alternatives, modifications and variations that are within the scope of the invention as set herein. Specific terminology used in the description of specific embodiments is for the purpose of illustration and not to limit the scope of the invention.

Unless defined otherwise, all technical and scientific terms used herein have the same meanings as commonly understood by one of ordinary skill in the art. Although any methods, materials, and devices similar or equivalent to those described herein can be used in the practice or testing of embodiments of the present invention, the preferred methods, materials, and devices are now described. All publications mentioned herein are incorporated by reference. Nothing herein is to be construed as an admission that the invention is not entitled to antedate such disclosure by virtue of prior invention.

The present invention is directed to novel golf club heads that are preferably top-head weighted and taper in a uniform fashion vertically from a thicker top line portion of club face to a thinner sole of the club head. Optionally, the sole portion of the club head may taper horizontally in a uniform fashion from a narrower heel dimension to a thicker toe dimension. The Reverse Aerodynamics™ club head designs of the invention will not get stuck in turf, will change the face angle upon impact with a golf ball to be in a stronger hitting position, and will have an increased club head speed. The club heads of the invention may be made out of any material, including but not limited to metal, composites, and metal alloys. In a preferred embodiment, greater than 50% of the weight of the club head will be above the horizontal mid-line of the club head and greater than 60% or the weight of the club will be beyond the vertical mid-line in the toe region. Golf irons, drivers, and fairway woods, are within the scope of the invention.

The present invention provides a golf club head having a head body having an essentially planar front impact face with a predefined loft angle for contacting a ball wherein said heel region of said front face is shorter than said toe region of said front face; an essentially planar back side wherein said heel region of said back side is shorter than said toe region of said back side; a heel; a toe; a hosel in the area of the heel having a predefined lie angle with the club body for receiving a shaft; and an essentially planar top, wherein said top extends linearly from the heel region to a wider toe region; and an essentially planar sole on the bottom of said head body that has a predetermined angle for contacting the ground when the head addresses a ball, and wherein said sole extends linearly from a heel region to a wider toe region and wherein said heel and toe dimensions of said sole are smaller than said heel dimensions of said top.

The present invention also provide a golf club head having a mass distribution providing a center of gravity that is located toward the heel of the club head in the same horizontal plane as the face center of the club., and also where the center of gravity is about 3.2 mm from the face center toward the heel of the . In an embodiment of the invention, the club head is an iron wherein the top has a toe width of about 21.3±2.5 mm and a heel width of about 14.5±2.5 mm, and the sole has a toe width from about 11.2±2.5 mm to about 15.1±2.5 mm and a heel width from about 9.9±2.5 mm to about 13.9±2.5 mm.

Preferably the club head of an iron that has a weight from about 200 to about 350 grams. The he golf club heads of the invention may have varying loft angles, including loft angles of the front face from about 20° to 65°. The golf club heads of irons are preferably made of stainless steel.

In the golf club heads of the invention, about 55-59% of the weight of said club head is located above the horizontal midline of the club head and about 41-45% of the club head weight is below the midline, and where about 63-67% of the club head weight is in the toe region from the vertical midline of the club head and about 33-37% of the club head weight is in the heel region from the vertical midline of the club head.

The present invention provides a head body having an essentially planar or crowned front impact face with a predefined loft angle for contacting a ball wherein the heel region of the front face is shorter than the toe region of the front face; an essentially planar or crowned back side wherein the heel region of the back side is shorter than the toe region of the back side; a heel wherein the face side of the heel is shorter than the back side of the heel; a toe wherein the face side of the toe is shorter than the back-side of the toe; a hosel in the area of the heel having a predefined lie angle with the club body for receiving a shaft; and an essentially planar or crowned top, wherein the top extends linearly from the heel to the toe; and an essentially planar sole on the bottom of the head body wherein the sole extends linearly from a heel region to the toe region and where the area of the sole is smaller than the top, including fairway woods and drivers.

Fairway woods of the invention generally have a weight from about 200 to about 220 grams. Drivers of the invention generally have a top with a toe width of about 70-75 mm and a heel width of about 40-46 mm, and the sole has a toe and heel width of about 44 mm. Drivers are preferably made of titanium with a weight from about 190 to about 210 grams, but may also be made of any convenient material. For example, woods or drivers may be made of titanium, stainless steel, composite, or combination thereof. As with irons, woods and drivers have a mass distribution providing a center of gravity that is located toward the heel of the club head in the same horizontal plane as the face center of the club, and preferably have a center of gravity is about 3.2 mm from the face center toward the heel of the club head.

BRIEF DESCRIPTION OF THE DRAWINGS

The accompanying drawings, which are incorporated in and form a part of the specification, illustrate embodiments of the present invention and, together with the description serve to explain the principles of the invention. The embodiments illustrated in the drawing should not be read to constitute limiting requirements, but instead are intended to assist the reader in understanding the invention.

FIG. 4 is a top line view of a golf club iron head of the invention.

FIG. 5 is a sole line view of the golf club iron head of FIG. 4.

FIG. 6 is a front view of the hitting face view of a golf club iron head of the invention. FIG. 6A is a cross-sectional view taken from the toe end of the golf club head of FIG. 6. FIG. 6B is a cross-sectional view taken from the heel end of the golf club head of FIG. 6.

FIG. 12 is a No. 3 fairway wood club head of the invention wherein FIG. 12A is a sole or bottom perspective view of the club head; 12B is a perspective heel view of the club head; 12C is a perspective toe view of the club head; 12D is a is a perspective view of the back side of the club head;, 12E is a longitudinal cross sectional view of the club head; and 12F is a perspective front view of the hitting face of the club head.

FIG. 13 is a No. 5 fairway wood club head of the invention wherein FIG. 12A is a sole or bottom perspective view of the club head; 12B is a perspective heel view of the club head; 12C is a perspective toe view of the club head; 12D is a is a perspective view of the back side of the club head; 12E is a longitudinal cross sectional view of the club head; and 12F is a perspective front view of the hitting face of the club head.

FIG. 14 is a No. 7 fairway wood club head of the invention wherein FIG. 12A is a sole or bottom perspective view of the club head; 12B is a perspective heel view of the club head; 12C is a perspective toe view of the club head; 12D is a is a perspective view of the back side of the club head; 12E is a longitudinal cross sectional view of the club head; and 12F is a perspective front view of the hitting face of the club head.

DETAILED DESCRIPTION OF THE INVENTION

Figure 1:
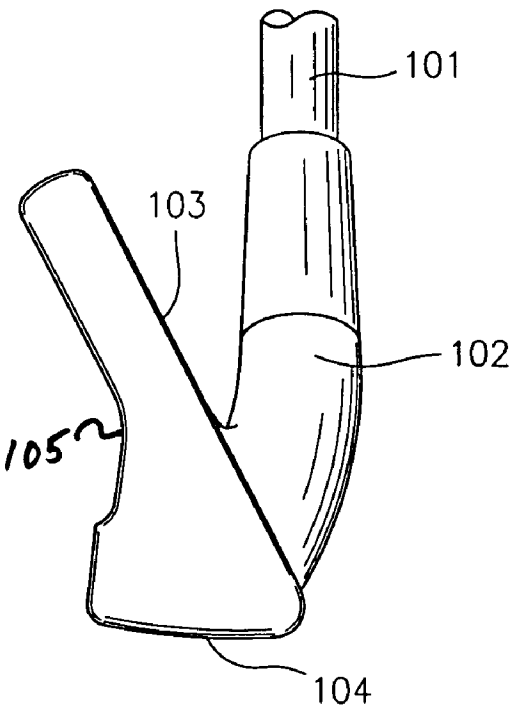
FIG. 1 (PRIOR ART)
FIG. 1 is a toe end view of a representative state of the art golf iron head.

Referring now to FIG. 1, there is shown a toe-end view of a contemporary iron golf club head. Shown is shaft 101, hosel 102, front hitting face 103, sole 104, and rear face 105. It can be seen that the state of the art of golfing irons are bottom-head or sole weighted where most of the weight of the iron head is in the lower portion of the face of the club.

Figure 2:
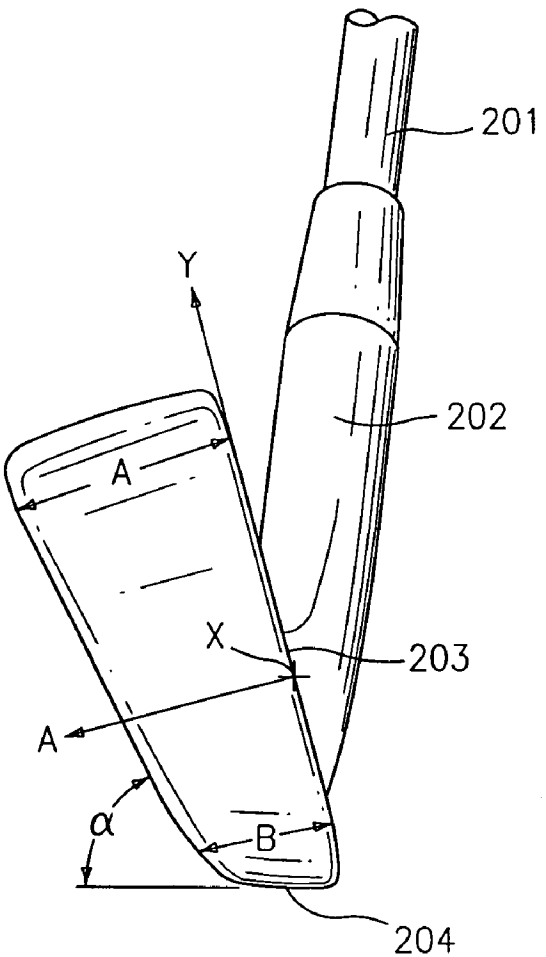
FIG. 2 is a toe end view of a golf iron head of the invention.

Referring now to FIG. 2, shown is a toe-end view of an iron golf club head of the invention. Shown is shaft 201, hosel 202, front hitting face 203 and sole 204. In contrast to the sole-weighted design of contemporary golf club irons of FIG. 1, the golf head of the invention is top head weighed. The distance A represents the maximal thickness of the top line of the toe region; the distance B represents the minimal thickness of the sole of the toe region as shown in Table 1 of Example 1.

Figure 3:
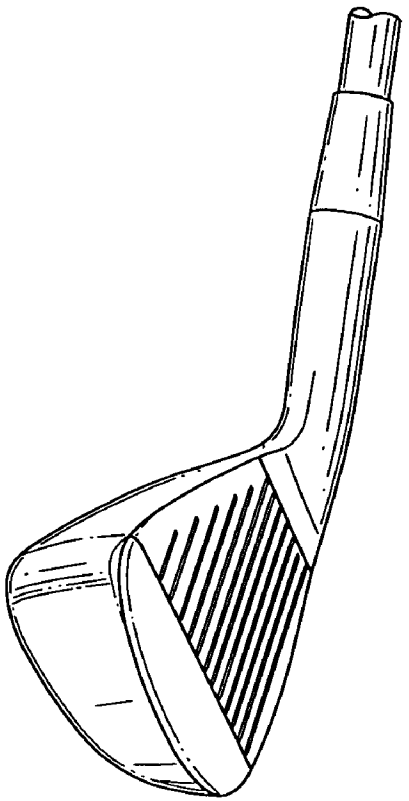
FIG. 3 is a perspective view of a golf iron head of the invention.

Referring now to FIG. 3, shown is a perspective view of an iron golf club head of the invention. Shown is shaft 301, hosel 302, heel 303, sole 304, toe 305, hitting front face surface 306, top line surface 307. In contrast to the sole-weighted state of the art iron golf club head, the golf head of the invention is top-head weighted.

Referring now to FIG. 4, shown is a top line view of a golf club iron head of the invention where distance A represents the maximal distance of the width of the toe region of the top line surface and distance B represents the minimal distance of the width of the heel region of the top line surface.

Referring now to FIG. 5, shown is bottom line view of a golf club head of the invention where distance D represents the maximal distance of the width of the club head at the toe region of the sole and distance C represents the minimal distance of the width of the heel region of the bottom line surface. The club head has a vertical taper in width from top line to the sole while simultaneously tapering horizontally from toe to heel.

Referring now to FIG. 6, shown is a view of the hitting or front face of a golf club iron head of the invention. FIG. 6A is a cross-sectional view taken from the toe end of the golf club head of FIG. 6 showing the straight front face of the club and the arcuate angle formed by the back side surface at the sole. FIG. 6B is a cross-sectional view taken from the heel end of the golf club head of FIG. 6. Point Z is the center of the face of the club. The center is conveniently determined by the intersection of the midline horizontal X axis and the midline vertical Y axis as illustrated. The area defined by $L_2$ and $L_3$ represents the delineated hitting surface (horizontal grooves and frosted like appearance are not illustrated).

Figure 7:
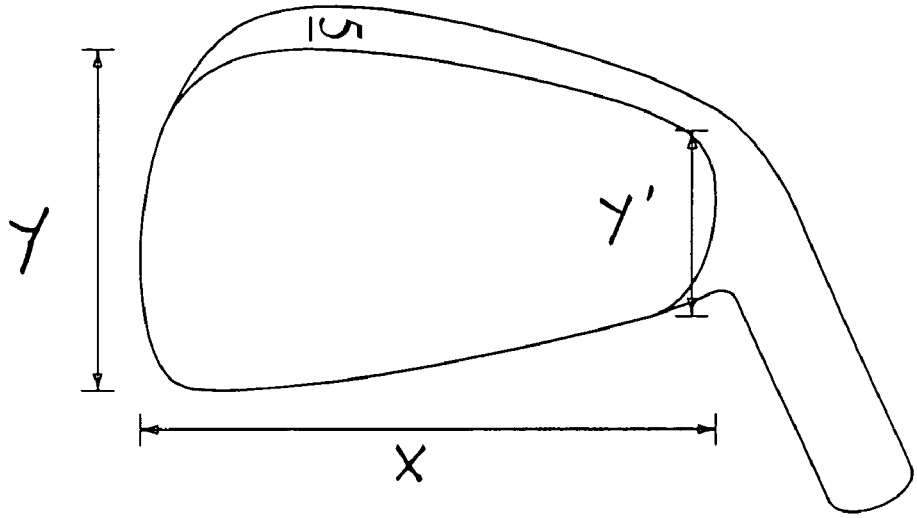
FIG. 7 is a perspective view of the back face of a 5 iron golf club head of the invention.

Referring now to FIG. 7, shown is a perspective view of the back face of a 5 iron golf club head of the invention. Shown is distance Y which is the maximum vertical height of the club at the toe and distance $Y^1$ the maximum vertical height of the club at the heel. Distance X is the length of the club measured from hosel to toe.

Figure 8:
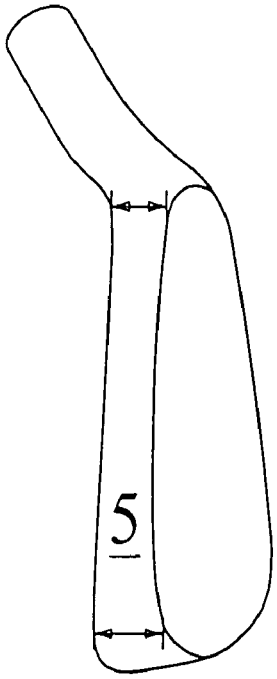
FIG. 8 is a top line view of a 5 iron golf club head of the invention.

Referring now to FIG. 8, shown is a top line view of a 5 iron golf club head of the invention. The distance A is the maximum width of the club at the toe and distance B is the maximum width of the heel.

Figure 9:
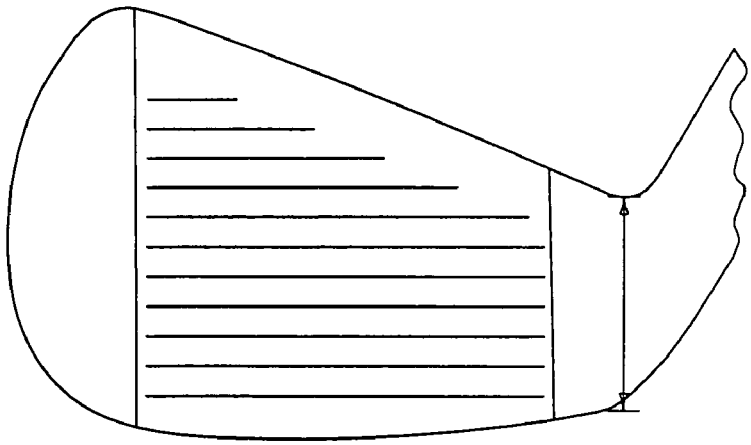
FIG. 9 is a front view of the hitting face of the 5 iron club head shown in FIGS. 7 and 8.

Referring now to FIG. 9, shown is a front view of the hitting face of the 5 iron club head shown in FIGS. 7 and 8. The distance $Y^1$ is the height of the club at the heel. Shown is the hitting surface area 901 defined by a centrally-located area having horizontal grooves and generally a non-smooth textured surface.

Figure 10:
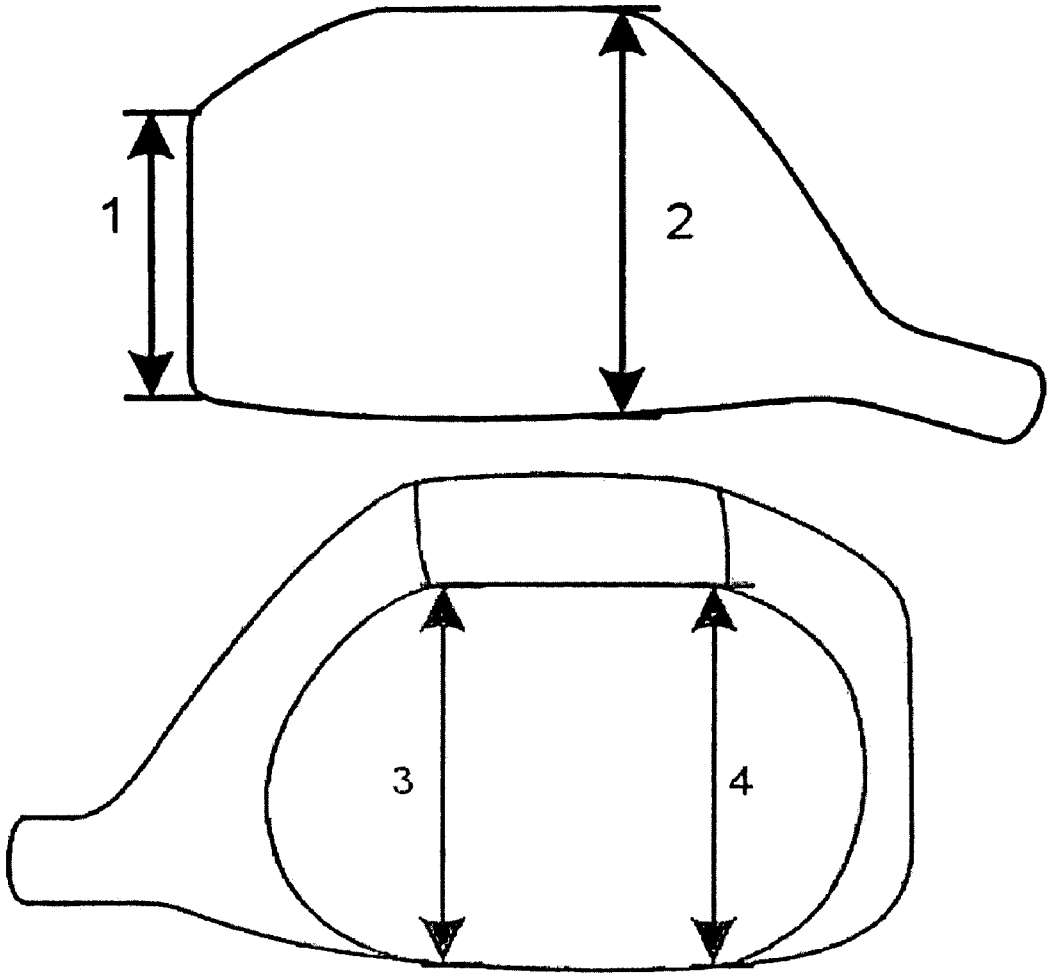
FIG. 10 is a view of the top and the sole of the driver.
Figure 11A:
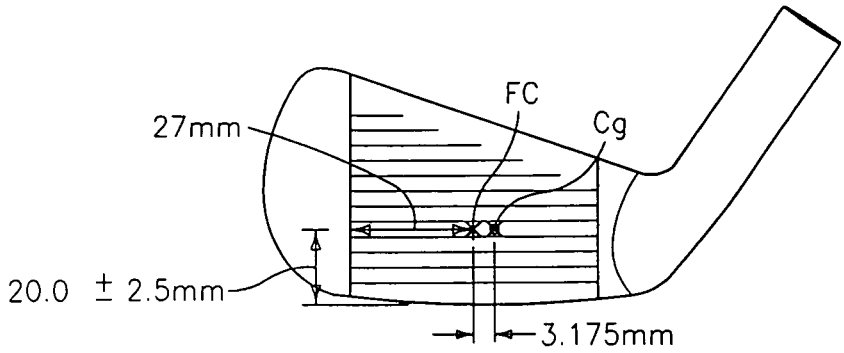
FIG. 11A is a front view of the hitting face of a 3 iron club head of the invention.
Figure 11B:
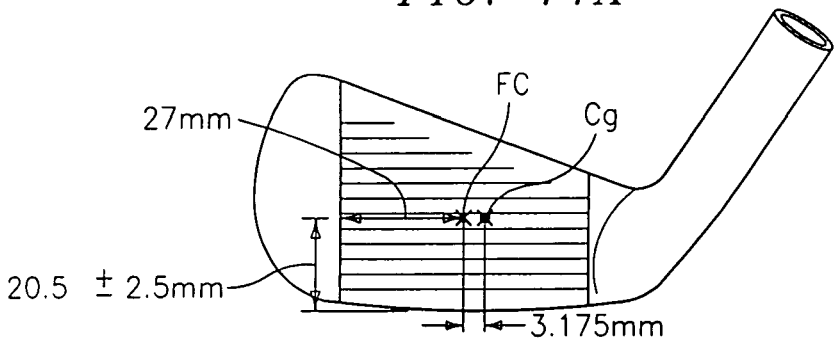
FIG. 11B is a front view of the hitting face of a 4 iron club head of the invention.
Figure 11C:
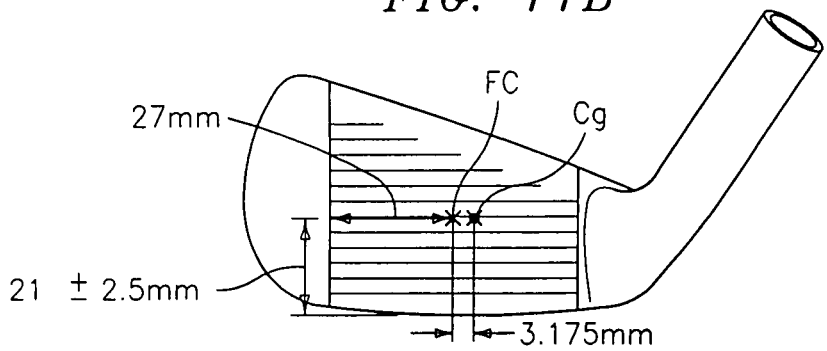
FIG. 11C is a front view of the hitting face of a 5 iron club head of the invention.
Figure 11D:
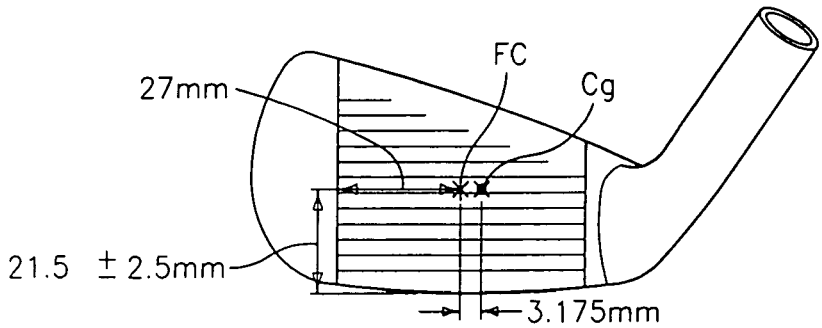
FIG. 11D is a front view of the hitting face of a 6 iron club head of the invention.
Figure 11E:
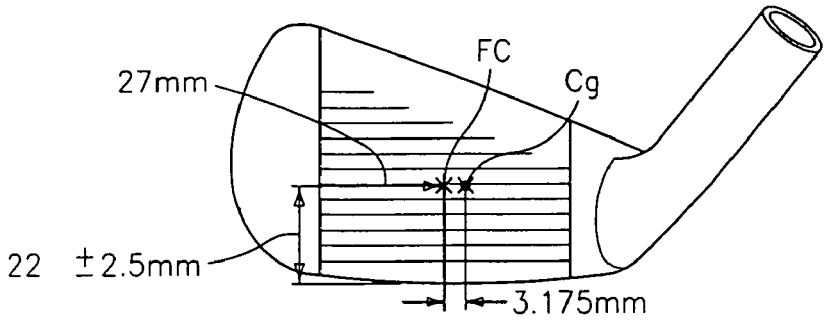
FIG. 11E is a front view of the hitting face of a 7 iron club head of the invention.
Figure 11F:
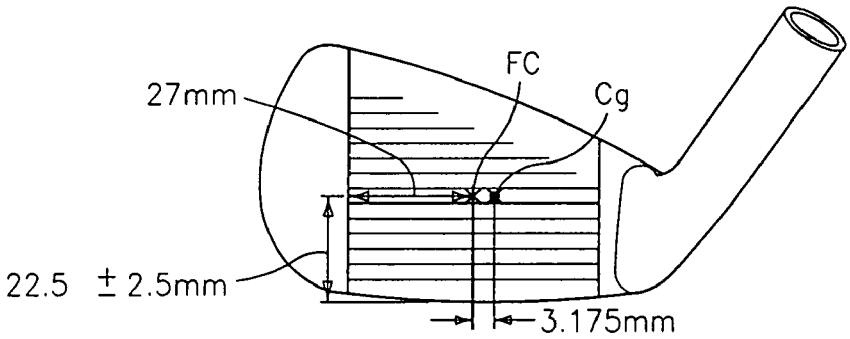
FIG. 11F is a front view of the hitting face of an 8 iron club head of the invention.
Figure 11G:
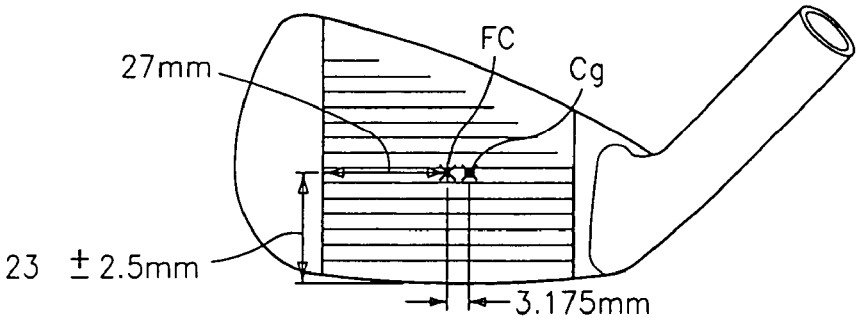
FIG. 11G is a front view of the hitting face of a 9 iron club head of the invention.
Figure 11H:
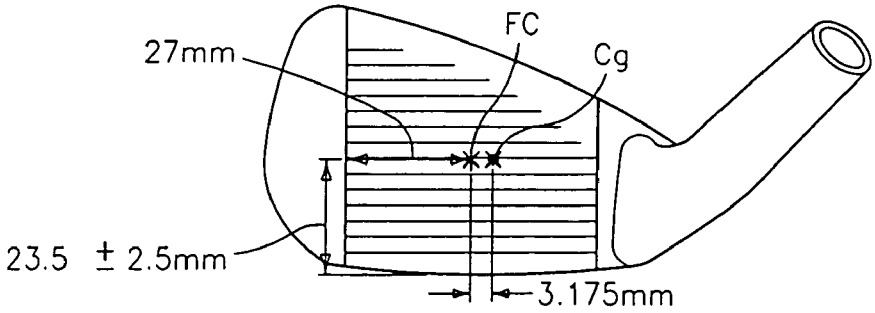
FIG. 11H is a front view of the hitting face of a pitching wedge club head of the invention.
Figure 11I:
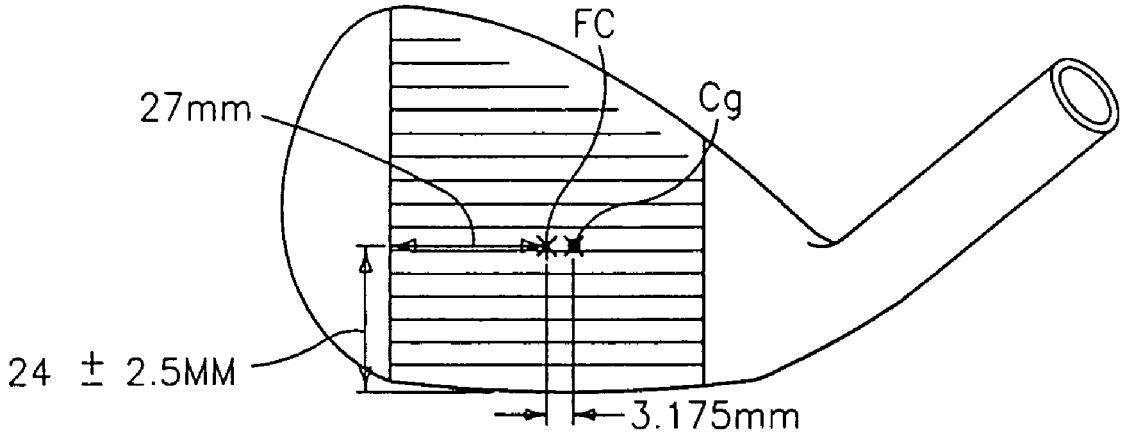
FIG. 11I is a front view of the hitting face of a sand wedge club head of the invention.
Figure 11J:
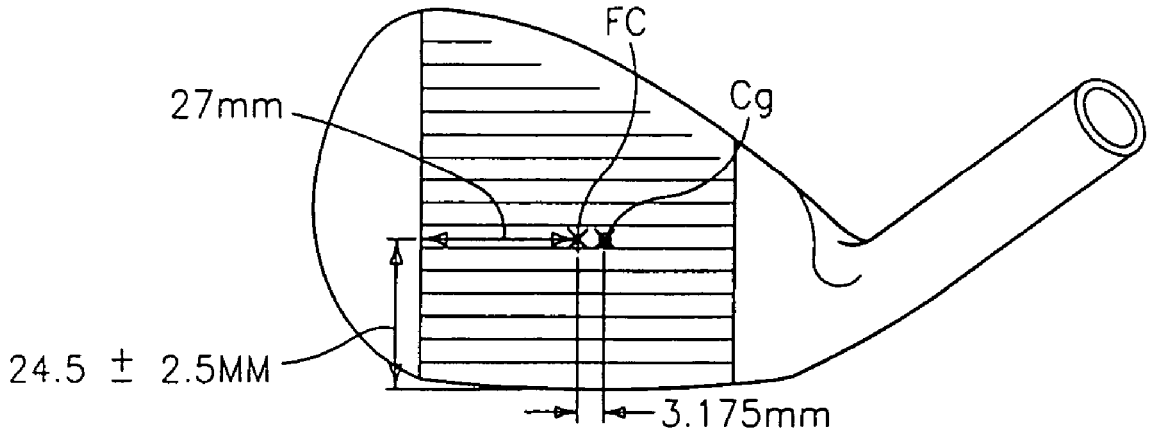
FIG. 11J is a front view of the hitting face of a lob wedge club head of the invention.

Referring now to FIG. 10, shown is a top and bottom view of the driver of the invention illustrating the top toe width 1, the top heel width 2, the bottom or sole heel width 3, and the sole toe width 4.

Referring now to FIGS. 11A through 11J, shown are selected dimensions of the irons 3-9 (FIGS. 11A-11G), a pitching wedge (FIG. 11H), a sand wedge (FIG. 11I) and a lob wedge (FIG. 11J) that were fabricated in Example 1. Shown in all club heads are FC (the face center) and Cg (the center of gravity) of the clubs. It can be seen that in all cases, the center of gravity of the club heads is located approximately at the same distance from the face center along the horizontal axis (i.e., approximately 3.2 mm from the face center toward the heel of the club).

Figure 12:
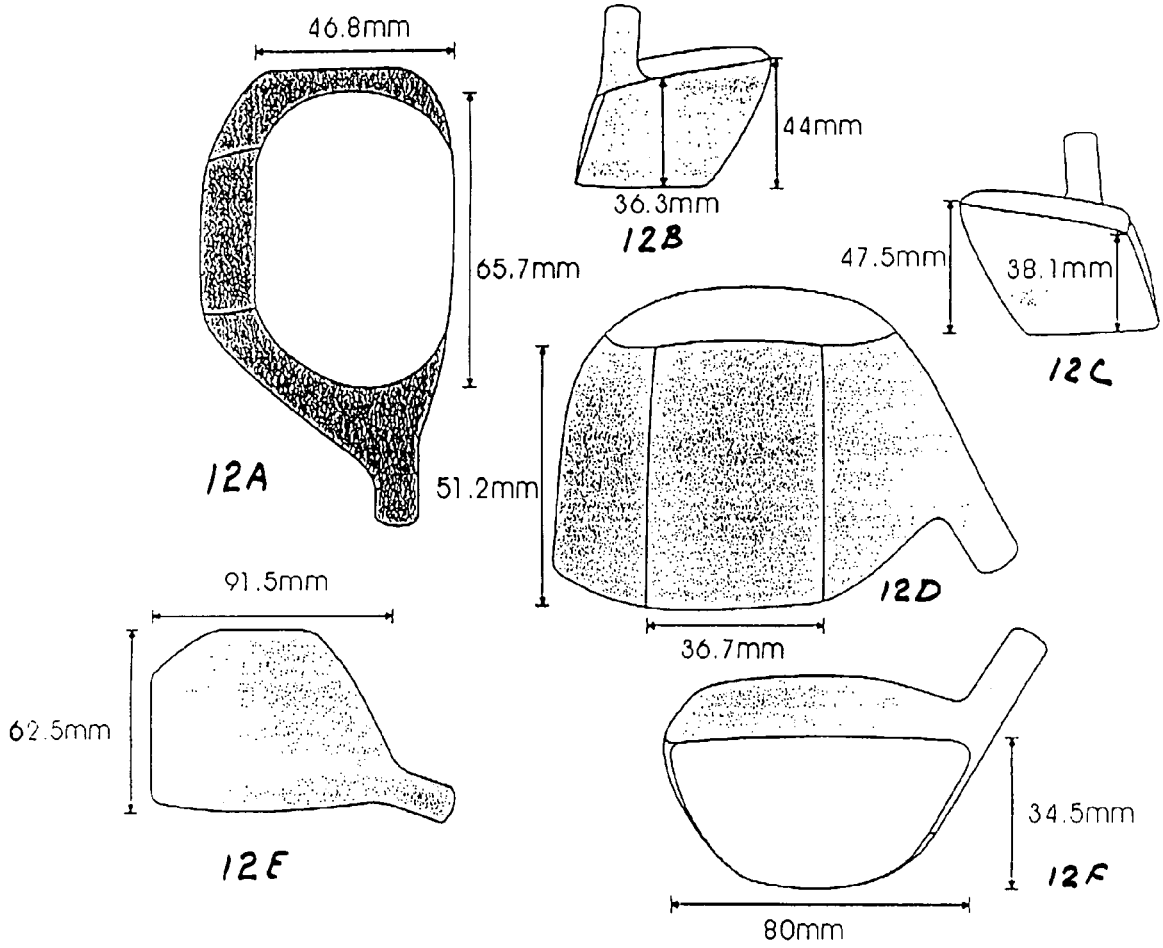
Figure 13:
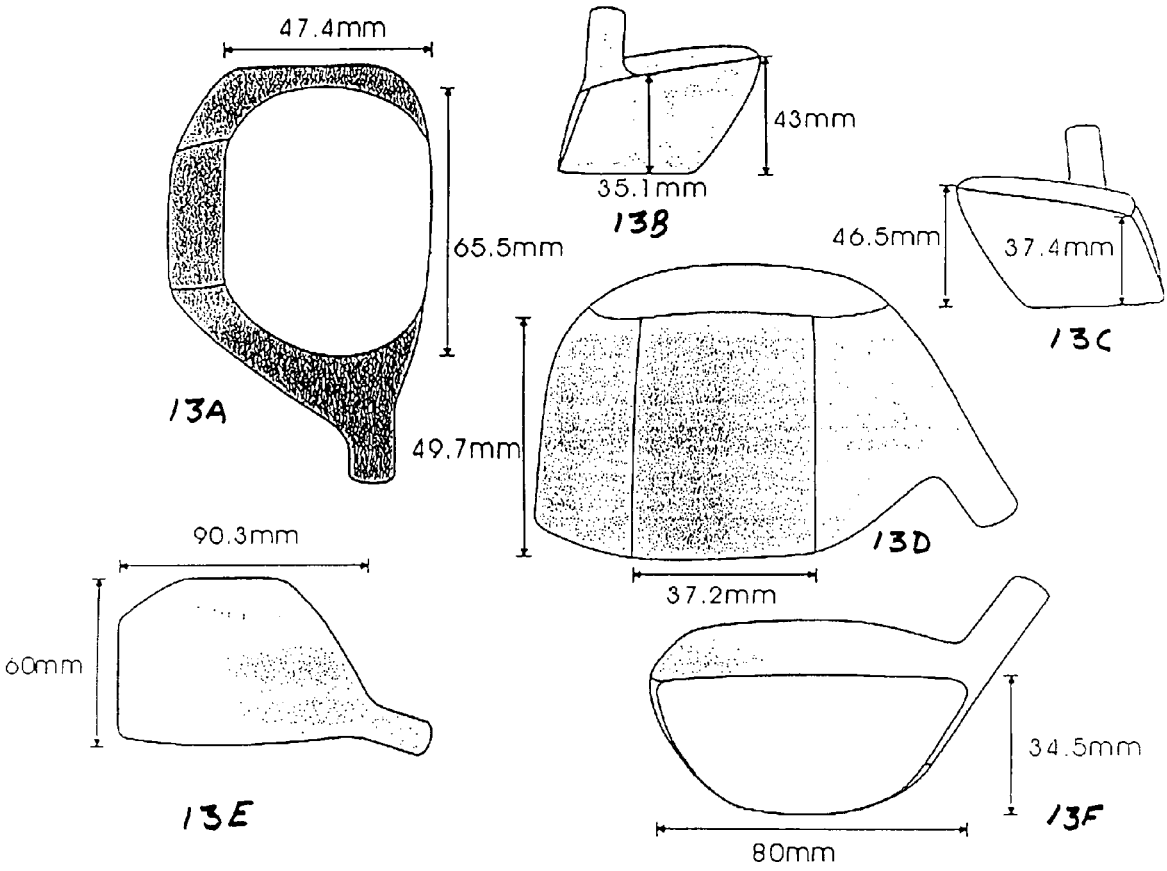
Figure 14:
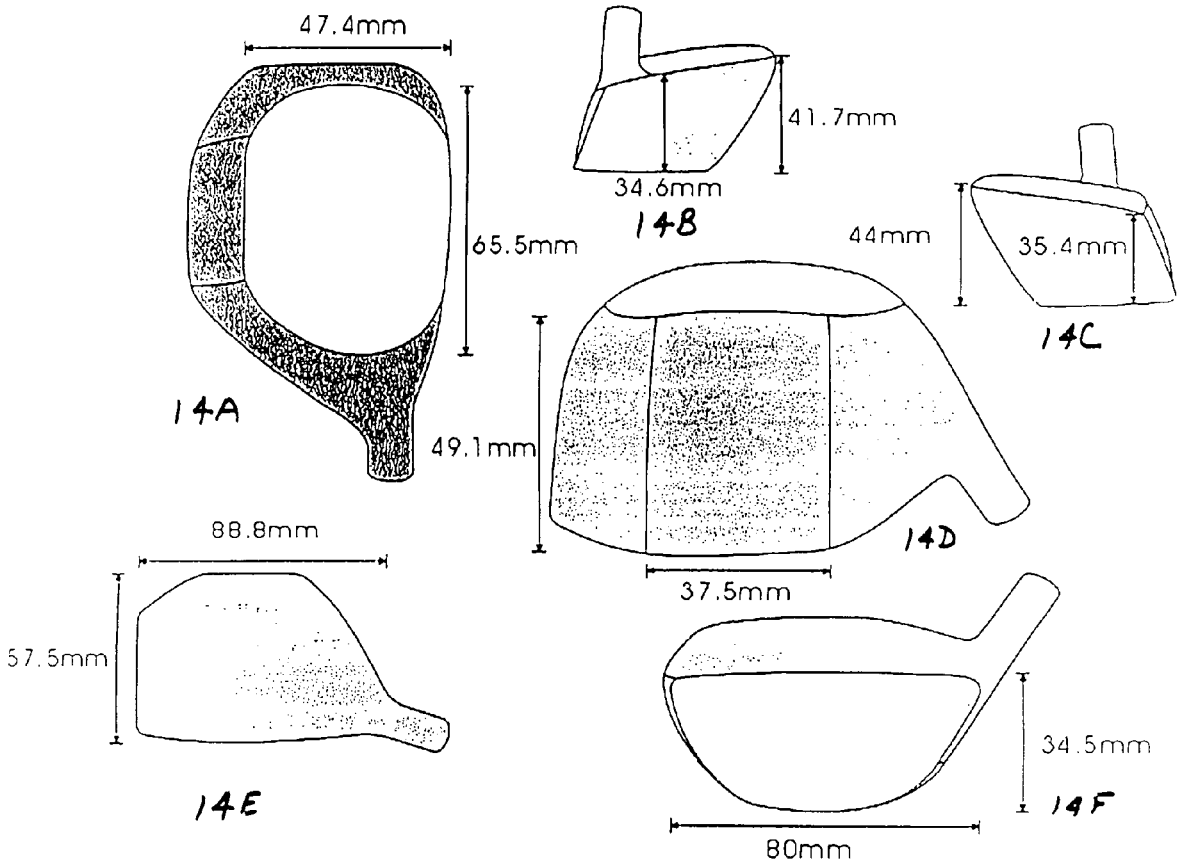

Referring now to FIGS. 12-14, shown are selected dimension specifications of fairway woods Nos. 3, 5 and 7. These are common fairway woods in a set of golf clubs. FIG. 12 is a No. 3 fairway wood club head of the invention wherein FIG. 12A is a sole or bottom perspective view of the club head; 12B is a perspective heel view of the club head; 12C is perspective toe view of the club head; 12D is a is a perspective view of the back side of the club head;

12E is a longitudinal cross sectional view of the club head; and 12F is a perspective front view of the hitting face of the club head. FIG. 13 is a No. 5 fairway wood club head where FIG. 12A is a sole or bottom perspective view of the club head; 12B is a perspective heel view of the club head; 12C is a perspective toe view of the club head; 12D is a is a perspective view of the back side of the club head; 12E is a longitudinal cross sectional view of the club head; and 12F is a perspective front view of the hitting face of the club head. FIG. 14 is a No. 7 fairway wood club head where FIG. 12A is a sole or bottom perspective view of the club head; 12B is a perspective heel view of the club head; 12C is a perspective toe view of the club head; 12D is a is a perspective view of the back side of the club head; 12E is a longitudinal cross sectional view of the club head; and 12F is a perspective front view of the hitting face of the club head.

Figure 15:
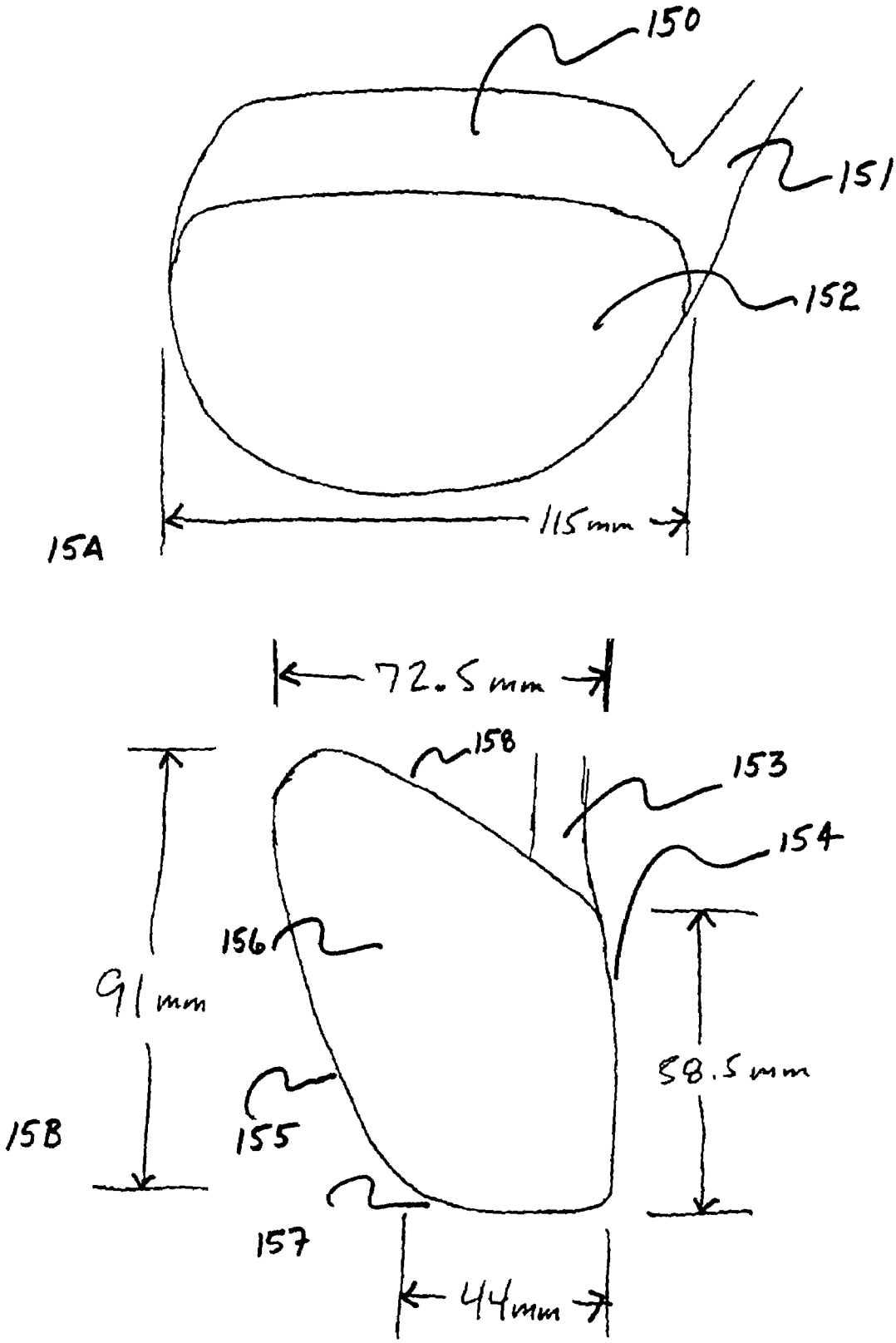
FIG. 15 is a driver head of the invention; 15A is a perspective view of the front face; 15B is a toe view of the driver head.

Referring now to FIG. 15, a driver golf club head of the invention is illustrated. FIG. 15A is a perspective view of the driver head showing the length of the club (about 115 mm). Shown in FIG. 15A is the top 150, the hosel 151, and the front hitting face 152. Shown in FIG. 15B as a toe view of the driver head, is the hosel 153, the front hitting face 154, the back 155, the toe 156 the top 158, and the sole 157. It can seen from FIG. 15B, that the sole width is approximately 44 mm and the top width of the head is approximately 72.5 mm.

The literature is replete with various designs of golf club heads that seek with their structural differences to improve club functional characteristics. The moment of inertia of clubs is critical component that may be varied by positioning of the mass of clubs. The center of gravity of a club will vary with mass location that can be changed with addition of weigh (i.e.,lead strips are sometimes applied to the back face of clubs) or adjustable means (adjustable screws in the club).

The present invention provides novel golf club heads that will efficiently transfer the forces created by a golf club swing to a struck golf ball. The golf club heads of the invention are top-head weighted in the vertical direction and toe weighted in the vertical direction. The club heads of the invention have a thick top line and greater mass at the top of the club face in relation to a thin and smaller mass in sole region of the club head. The club heads gradually decreasingly taper from the top line of the club head to the sole of the club head. In a preferred embodiment, at least 50% of the mass of the club head will be above the horizontal mid-line of the head (c.f., the plane defined by axis X of FIG. 6). The heavier top line will reverse its position at impact. Conventional golf club heads having standard loft and lie angles stay intact at the same angle on impact as they had at the beginning of the golf swing. Golf clubs of the invention will transform their loft angles of impact when contacting golf balls and become approximately 4 to 6 degrees stronger in the hitting face angle at impact. For example, it is projected that this transformation will mean that a number 5 iron might become a number 3 iron at impact. Mother irons will function similarly.

The unique shape and dimensions of the golf heads of the invention provide irons, fairway woods, and drivers with a unique distribution of weight and improved performance characteristics. With reference to FIG. 6, a typical conventional iron (c.f., FIG. 1) has an approximate weight distribution of quadrant A=26%, quadrant B=15%, quadrant C=24% and quadrant D=35%. In contrast, a typical iron of the invention has a weight distribution of LA=37%, B=19.6%, C=15.6% and D=27.8%. This would provide a general weight in the top half of the club head of the invention (above the midline) of approximately 57% with the bottom half of the club head having approximately 43% of the weight of the club head. With reference to the hosel, the weight distribution of the toe region of the club (the region distal to vertical midline axis Y of FIG. 6) would have approximately 65% of the club head weight with the heel region (the region proximal to vertical axis Y of FIG. 6) having approximately 35% of the club head weight. The club heads of the invention may be made of any material or combination of materials as long as the unique shape and weight distribution is maintained. The shape and mass distribution of the clubs of the invention forces the club to stay square through the hitting zone much longer than a typical club, thus producing significantly straighter and longer shots for golfers of all abilities.

Because of the thicker top line and top head weighed design of the club heads of the invention, the golf shaft will flex or whip and cause the unique transformation of the face angle when impacting a golf ball. The shafts and grips fitted to the club heads of the invention may be any convenient shafts or grips. Preferably, the heads will be made to accommodate tapered shafts. The design of the novel golf club of the invention is referred of as a reverse aerodynamic design. Clubs of reverse aerodynamic design will have several advantages over conventional golf clubs. One of the main advantages of the reverse aerodynamic clubs of the present invention is that the clubs will have a low tendency to get stuck in turf. The sole of the clubs will have decreased area contacting the turn upon ball impact translating into reduced frictional forces.: The clubs will appear to go through rough as though there were no resistance. Regardless of the lie, the ball will fly or come out like it's sitting on the fairway. Also, reverse aerodynamic clubs will whip and change the face angle of the club approximately 3-4 degrees. Changing the face angle will result in a stronger hitting position. In addition, reverse aerodynamic clubs will have increased club head speed. It is estimated that club head speed may increase about 10 miles per hour beyond the average speed of 80 miles per hour. The net result is that reverse aerodynamic golf clubs of the invention will provide golfers with greater distance than alternative club designs. The design is applicable to all golf irons, fairway woods, and drivers of the invention.

The unique shape providing the mass distribution of golf club heads of the invention have the advantage of holding the ball more through the hitting area than conventional clubs of the art. Because the ball stays on the hitting face of the club longer than conventional clubs, more control is provided and the shot will go straighter. The golfer can swing the club easier than conventional clubs because the top weight of the club will thrust down and through the hitting area. This will allow the club head to stay in line to the target and give a straighter more controlled shot.

The club heads of the invention may be made from any convenient material. Uniform metals (i.e., stainless steel; titanium, etc.) are preferred. Regardless of the material that the club heads of the invention are made from, including but not limited to metals, alloys, composites, polymers, resins and combinations thereof, with adherence to the disclosed design shape providing the mass distribution characteristics of the clubs, the center of gravity will be approximately in the same location inside of the center of the selected club. The center of gravity can be calculated or conveniently determined empirically by taking a selected club head, placing it on a needle point, and rotating the needle point on the club head until the club head balances on the point.

EXAMPLE 1

The following golf club heads were designed and fabricated: iron heads Nos. 3, 4, 5, 6, 7, 8, 9, pitching wedge, sand wedge and lob wedge; fairway woods Nos. 3, 5 and 7; and a driver. The irons and fairway woods were made from stainless steel and the driver was made from titanium. The irons were made in three pieces from a front face mold, a rear face mold, and a hosel mold and welded together. Irons were polished and surface treated to provide horizontal score lines and a standard centralized burnished-like front face hitting area. Score lines do not exceed 35/1000 inch.

The fairway woods and driver were conventionally molded and fabricated with a hollow interior section. The fabricated iron heads are illustrated in FIGS. 11A-11J. The fabricated fairway woods are illustrated in FIGS. 12-14.

The center of gravity of the irons of FIGS. 11A-11J were determined and illustrated in relation to the location from the face center of the club heads. It can be seen that while the Center of Gravity (Cg) of the club heads varies slightly in the vertical axis depending on the club (from 20.0±2.5 mm with a #3 iron of FIG. 11A to 24.5 mm±2.5 mm for the lob wedge of FIG. 11J), the Cg remains approximately 0.125" (3.175 mm) from the Face Center (FC) of each club.

Specification results are presented in Tables 1-3 below. In Table 1, A B, C and D correspond to toe and heel dimensions of the top and sole as illustrated in FIGS. 4 and 5.

TABLE 1

Top &Bottom Line, Loft and Weight Specifications [c.f. FIGS. 4 &5}

| Club | A Top Line Toe Width (in) | B Bottom Line Heel Width (in) | C Bottom Line (Sole) Heel Width (in) | D Bottom Line (Sole) Toe Width (in) | Loft Angle | Weight (grams) |
|---|---|---|---|---|---|---|
| 3 iron | 0.840 | 0.570 | 9.906 | 11.176 | 22° | 242 |
| 4 iron | 0.840 | 0.570 | 9.906 | 11.176 | 25° | 250 |
| 5 iron | 0.840 | 0.570 | 9.906 | 11.176 | 28° | 258 |
| 6 iron | 0.840 | 0.570 | 9.906 | 11.176 | 32° | 266 |
| 7 iron | 0.840 | 0.570 | 9.906 | 11.176 | 36° | 274 |
| 8 iron | 0.840 | 0.570 | 9.906 | 11.176 | 40° | 282 |
| 9 iron | 0.840 | 0.570 | 10.668 | 12.319 | 45° | 290 |
| Pitching Wedge | 0.840 | 0.570 | 11.684 | 13.843 | 50° | 298 |
| Sand Wedge | 0.840 | 0.570 | 12.954 | 15.113 | 55° | 306 |
| Lob Wedge | 0.840 | 0.570 | 12.954 | 15.113 | 60° | 314 |

TABLE 2

| | FRONT FACE | | REAR FACE | |
|---|---|---|---|---|
| Club | Toe height (mm) | heel height (mm) | Toe Height (mm) (mm) | Heel Height (mm) |
| 3 iron | 11.5 | 10 | 21.24 | 14.5 |
| 4 iron | 11.5 | 10 | 21.24 | 14.5 |

TABLE 2-continued

| Club | FRONT FACE | | REAR FACE | |
|---|---|---|---|---|
| | Toe height (mm) | heel height (mm) | Toe Height (mm) (mm) | Heel Height (mm) |
| 5 iron | 11.8 | 10.5 | 21.75 | 14.5 |
| 6 iron | 12 | 10.5 | 21.25 | 14.5 |
| 7 iron | 12.5 | 11 | 21 | 14.8 |
| 9 iron | 12.7 | 10.5 | 20.94 | 14.49 |
| Pitching Wedge | 13 | 10.7 | 22 | 15 |
| Sand Wedge | 14 | 11.5 | 20.61 | 13.68 |
| Lob Wedge | 15 | 14.5 | 20.72 | 14.54 |

TABLE 3

| Club | TOP | | BOTTOM/SOLE | |
|---|---|---|---|---|
| | Toe Width (mm) [1 if FIG. 16] | heel Width (mm) [2 of FIG. 17] | Toe Width (mm) [4 of FIG. 17] | Heel Width (mm) [3 of FIG. 17] |
| Fairway Wood #3 | 46.8 | 62.9 | 46.95 | 46.95 |
| Fairway Wood #5 | 44.7 | 59.9 | 46.72 | 46.72 |
| Fairway Wood #7 | 42.5 | 57.5 | 45.7 | 45.7 |
| Driver | 72.5 | 44 | 44 | 44 |

TABLE 4

| Club | Weight (g.) |
|---|---|
| Driver | 200 |
| Fairway Wood #3 | 208 |
| Fairway Wood #5 | 218 |
| Fairway Wood #7 | 218 |

Although the present invention describes in detail certain embodiments, it is understood that variation and modifications exist known to those skilled in the art that are within the invention. Accordingly, the present invention is intended to encompass all such alternatives, modifications and variation that are within the scope of the invention as set forth in the following claims.

What is claimed is:

1. A golf club head comprising:

a head body having an essentially planar front impact face with a predefined loft angle for contacting a ball wherein said heel region of said front face is shorter than said toe region of said front face;

an essentially planar back side wherein said heel region of said back side is shorter than said toe region of said back side;

a heel;

a toe;

a hosel in the area of the heel having a predefined lie angle with the club body for receiving a shaft; and an essentially planar top, wherein said top extends linearly from the heel region to a wider toe region; and an essentially planar sole on the bottom of said head body that has a predetermined angle for contacting the ground when the head addresses a ball, and wherein said sole extends linearly from a heel region to a wider toe region and wherein said heel and toe dimensions of said sole are smaller than said heel dimensions of said top.

2. The golf club head of claim 1, having a mass distribution providing a center of gravity that is located toward the heel of the club head in the same horizontal plane as the face center of the club.

3. The golf club head of claim 2, wherein said center of gravity is about 3.2 mm from said face center toward the heel of the club head.

4. The golf club head of claim 1, wherein said club head is an iron that has a weight from about 200 to about 350 grams.

5. The golf club head of claim 1, wherein said loft angle of said front face is from about 20° to 65°.

6. The golf club head of claim 1, wherein said club head is a stainless steel iron.

7. A golf club head comprising:

a head body having an essentially planar front impact face with a predefined loft angle for contacting a ball wherein said heel region of said front face is shorter than said toe region of said front face;

an essentially planar back side wherein said heel region of said back side is shorter than said toe region of said back side;

a heel;

a toe;

a hosel in the area of the heel having a predefined lie angle with the club body for receiving a shaft; and an essentially planar top, wherein said top extends linearly from the heel region to a wider toe region; and an essentially planar sole on the bottom of said head body that has a predetermined angle for contacting the ground when the head addresses a ball, and wherein said sole extends linearly from a heel region to a wider toe region and wherein said heel and toe dimensions of said sole are smaller than said heel dimensions of said top; and wherein said club head is an iron wherein said top has a toe width of about 21.3±2.5 mm and a heel width of about 14.5±2.5 mm, and said sole has a toe width from about 11.2±2.5 mm to about 15.1±2.5 mm and a heel width from about 9.9±2.5 mm to about 13.9±2.5 mm.

8. A golf club head comprising:

a head body having an essentially planar front impact face with a predefined loft angle for contacting a ball wherein said heel region of said front face is shorter than said toe region of said front face;

an essentially planar back side wherein said heel region of said back side is shorter than said toe region of said back side;

a heel;

a toe;

a hosel in the area of the heel having a predefined lie angle with the club body for receiving a shaft; and an essentially planar top, wherein said top extends linearly from the heel region to a wider toe region; and an essentially planar sole on the bottom of said head body that has a predetermined angle for contacting the ground when the head addresses a ball, and wherein said sole extends linearly from a heel region to a wider toe region and wherein said heel and toe dimensions of said sole are smaller than said heel dimensions of said top; and wherein said about 55-59% of the weight of said club head is located above the horizontal midline of said club head and about 41-45% of said club head weight is below said midline, and wherein about 63-67% of said club head weight is in the toe region from the vertical midline of said club head and about 33-37% of said club head weight is in the heel region from the vertical midline of said club head.

9. A golf club head comprising:

a head body having an essentially planar or crowned front impact face with a predefined loft angle for contacting a ball wherein said heel region of said front face is shorter than said toe region of said front face;

an essentially planar or crowned back side wherein said heel region of said back side is shorter than said toe region of said back side;

a heel wherein the face side of said heel is shorter than the back side of said heel;

a toe wherein the face side of said toe is shorter than the back-side of said toe;

a hosel in the area of the heel having a predefined lie angle with the club body for receiving a shaft; and an essentially planar or crowned top, wherein said top extends linearly from said heel to a said toe; and an essentially planar sole on the bottom of said head body wherein said sole extends linearly from a heel region to said toe region and wherein the area of said sole is smaller than said top.

10. The golf club head of claim 9, wherein said golf club head is a fairway wood.

11. The golf club head of claim 9, wherein said golf club head is a driver.

12. The golf club head of claim 9, wherein said about 55-59% of the weight of said club head is located above the horizontal midline of said club head and about 41-45% of said club head weight is below said midline, and wherein about 63-67% of said club head weight is in the toe region from the vertical midline of said club head and about 33-37% of said club head weight is in the heel region from the vertical midline of said club head.

13. The golf club head of claim 9, wherein said club head is a fairway wood that has a weight from about 200 to about 220 grams.

14. The golf club head of claim 9, wherein said club head is a driver wherein said top has a toe width of about 70-75 mm and a heel width of about 40-46 mm, and said sole has a toe and heel width of about 44 mm.

15. The golf club head of claim 9, wherein said club head is a driver that has a weight from about 190 to about 210 grams.

16. The golf club head of claim 9, wherein said club head is a fairway wood or driver of material selected from the group of titanium, stainless steel, composite, or combination thereof.

17. The golf club head of claim 9, having a mass distribution providing a center of gravity that is located toward the heel of the club head in the same horizontal plane as the face center of the club.

18. The golf club head of claim 9, wherein said center of gravity is about 3.2 mm from said face center toward the heel of the club head.

* * * * *